United States Patent [19]

Hafner

[11] 4,122,643

[45] Oct. 31, 1978

[54] CONSTRUCTION PANEL

[76] Inventor: Joseph A. Hafner, 91 Dover Dr., Stoney Creek, Ontario, Canada

[21] Appl. No.: 861,922

[22] Filed: Dec. 19, 1977

Related U.S. Application Data

[63] Continuation-in-part of Ser. No. 766,107, Feb. 7, 1977, abandoned.

[51] Int. Cl.[2] ..... E04D 1/06

[52] U.S. Cl. ..... 52/520; 52/529; 52/545

[58] Field of Search ..... 52/520, 529–535, 52/545, 94, 588, 586, 536, 538

[56] References Cited

U.S. PATENT DOCUMENTS

| | | | |
|---|---|---|---|
| 640,593 | 1/1900 | Russell | 52/588 |
| 2,642,968 | 6/1953 | Roush et al. | 52/534 X |
| 3,150,464 | 9/1964 | Shmitt | 52/545 X |

FOREIGN PATENT DOCUMENTS

| | | | |
|---|---|---|---|
| 574,754 | 4/1959 | Canada | 52/539 |

*Primary Examiner*—Karl J. Bell

*Attorney, Agent, or Firm*—Rogers, Bereskin & Parr

[57] ABSTRACT

A building construction panel having, along a first marginal portion, first and second engaging means, and along a parallel second marginal portion a single engaging means adapted to engage either the first or second engaging means on the first marginal portion of an adjacent panel so that the panels can be disposed in lap or flush relation as desired, one of the portions of each panel terminating at a flange extending outwardly of the panel for use in connecting the panel to a building.

17 Claims, 17 Drawing Figures

CONSTRUCTION PANEL

This application is a continuation-in-part of U.S. patent application Ser. No. 766,107 filed on Feb. 7, 1977 now abandoned.

This invention relates to prefabricated construction materials and more particularly to prefabricated metal or plastic cladding materials.

Sheet metal and plastic cladding materials for constructional use are well known and take many different forms. Metals such as aluminum and steel may be precoated to provide long lasting decorative finishes and plastic claddings may be provided with any desired colour or surface finish. Cladding materials for ceilings, soffits, sidings and the like are usually prefabricated in suitable sized lengths and widths to provide a desired surface effect and to facilitate handling of the individual pieces. Joints between each piece are generally covered by an overlap with the adjacent piece and each piece is generally interlocked or interconnected with the next using any one of a number of known interlocking systems.

Generally, however, because of the need to securely interlock the panels so as to ensure a weather-tight surface, and a desire to provide a variety of decorative surface configurations, each type of cladding material is designed for a specific end use. Ceiling and soffit, vertical siding panels and at least one type of horizontal siding are usually applied so as to present a weathering or decorative surface that is essentially flush. Most other prefabricated horizontal siding panels are designed to be applied in a slightly zig zag configuration so as to simulate conventional lap or wood bevel siding. As with wood siding it is desirable to partially overlap each panel with the lower edge of the panel immediately above it so that the cladding can readily shed water.

The inventory of differently shaped pieces required by the stockist and applicator for various constructional uses is relatively large and costly to maintain. Furthermore, the wastage during cutting and installation is also relatively high because it is not usually possible to utilize the inevitable short lengths which accrue for other purposes. For example, during the installation of preformed metal and plastic lap siding it has heretofore not been possible to utilize the short scrap lengths for soffit panels, which are usually applied in flush configuration. It will be appreciated, therefore, that inventory and installation of cladding could be much simplified if a system could be devised which would enable use of the same panel for both lap or flush application for either siding or soffit and which could be produced using the same dies on a single piece of forming equipment, such as rolls or extruders.

U.S. Pat. No. 2,642,968 to Roush et al, teaches a panel for use in a prefabricated house structure. The panel can be attached in both the flush and overlap configurations and requires specially formed uprights to receive the panels. For this reason the panels taught by Roush could not be used on buildings generally. Also the Roush panels would require very accurate alignment for proper interlocking with one another and such alignment would be found only on prefabricated structures. Further, if the alignment is not accurate in the overlap condition gaps would appear between adjacent panels at the point of misalignment resulting in an unacceptable appearance. In the overlap condition the underside of each panel displays an upwardly extending channel which can shelter insects and which also detracts significantly from the overall appearance of the siding. For these reasons the Roush structure would not be acceptable for applicant's purpose.

It is an object of the present invention to provide panels formed to permit using the panels as vertical or horizontal siding, soffit or other application in either flush or lap relation as desired on existing as well as new building structures.

Thus in one of its aspects this invention provides a construction panel having, along a first marginal edge thereof, first and second engaging means and, along a parallel second marginal edge thereof, third engaging means for interengagement with either said first or said second engaging means of an adjacent said panel whereby adjacent said panels may be disposed in abutting relation to selectively position and retain a face of the panels alternatively flush or lapped.

The invention will be described in more detail hereinafter with reference to the drawings in which:

FIGS. 3 to 15 are composite schematic sectional views showing alternative embodiments of construction panels according to the present invention, each FIG. showing one embodiment in both flush and lap configurations; and FIGS. 1*a* and 15*a* illustrate alternative arrangements of the embodiments shown in FIGS. 15 and 16 respectively.

It will be appreciated that although the embodiments are drawn to show panels in both flush and lap configurations, in practice the panels would be applied in one configuration or the other. It will further be appreciated that the panels of the present invention may be applied as siding in either the vertical or horizontal mode, that is with the joints either perpendicular or parallel to the base of the building, or as soffit or ceiling panels, and that various decorative effects can be achieved by mixing the manner of installation. The present invention is applicable to any conventional panel material such as sheet metal or plastic.

Figure 1:
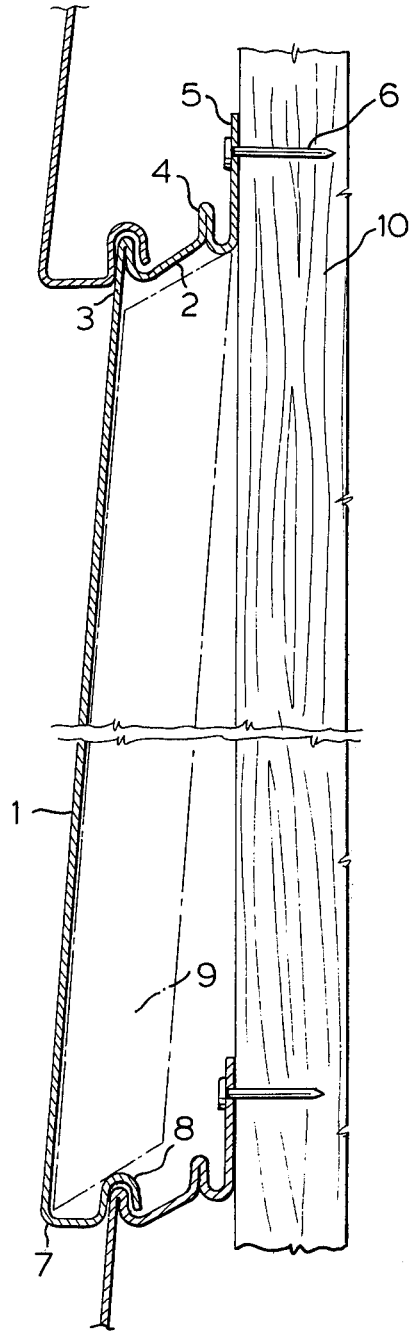
FIG. 1 is a sectional view of one embodiment of construction panels according to the present invention, the panels being in a lap configuration.
Figure 2:
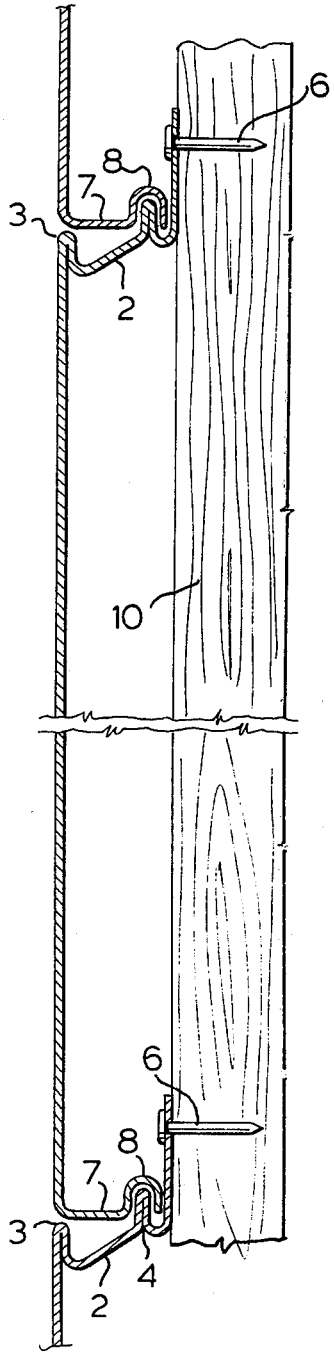
FIG. 2 is a sectional view of the panels of FIG. 1 showing the panels in a flush configuration.

Reference is made initially to FIGS. 1 and 2 to describe a preferred embodiment of the invention. An aluminum panel is shown having a constant cross-section and extending longitudinally on the side of a building. The panel is formed of sheet material and has a main portion 1 defining a front face which terminates at transverse extremities. A first portion 2 extends longitudinally of the panel and depends from one of the transverse extermities. The portion extends rearwardly and defines a pair of longitudinally extending projecting ribs 3 and 4 spaced in parallel with one another and terminating at a flange 5 extending outwardly and through which nails 6 may be driven to secure the panel along its length to a substrate or frame 10. A second portion 7 depends from the other transverse extremity and defines a longitudinally extending channel or recess 8 adapted to receive either one of the ribs 3 and 4. When channel 8 is located on rib 3 as in FIG. 1, the panels are assembled in lap siding configuration. A drop-in backer board 9 may be required for insulation and rigidity of the finished structure.

When channel 8 is received on rib 4 (as in FIG. 2) the panels are assembled in flush configuration and, depending upon the application, a backer board may or may not be required. It will be appreciated that the flush configuration of FIG. 2 is particularly suited for use as a soffit and no backer board is normally required for this application.

It should be noted that as seen in FIGS. 1 and 2 the ribs 3 and 4 are both spaced in parallel and spaced transversely of the panel so that when the rib 4 is engaged in channel 8 the rib 3 does not interfere with the location of the rib 4 in channel 8. Also, in the overlap condition the channel 8 contains a part of a front face of the main portion 1 of the panel. Consequently, if for any reason the rib 3 does not engage fully in the channel 8 the external appearance will not be affected because unlike the aforementioned Roush structure no crack or opening will be seen between the panels. This interengagement in which a part of the main portion is contained behind the adjacent panel is therefore of importance in understanding the requirements which the present structure must meet when it is being installed on less than perfect building surfaces. Variations in shape will be described with reference to other embodiments which also exhibit this feature.

It will be evident that this overlap condition requires the ribs 3 and 4 to be staggered both outwardly and rearwardly so that in the overlap condition the upper panel (as drawn) is lower than it would be in the flush condition.

Figure 3:
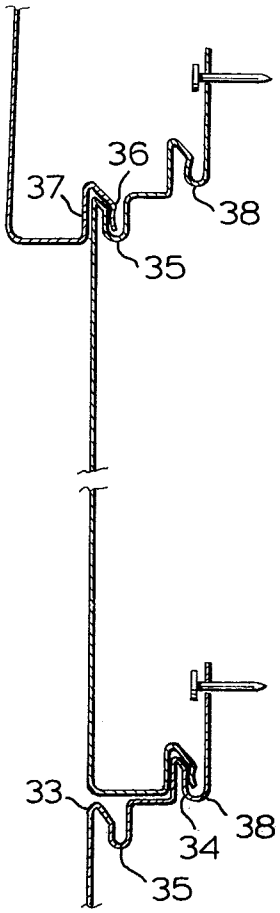

FIG. 3 shows a modification of the embodiment of FIGS. 1 and 2 wherein modified ribs 33 and 34 are also at different levels and in which there is provided a recess 35 adjacent rib 33 to receive and interlock a tail 36 of recess 37 when the panels are assembled in the lap configuration. Tail 36 is received and interlocks with modified ribs 34 and an associated recess 38 when the panels are assembled in the flush configuration.

Figure 4:
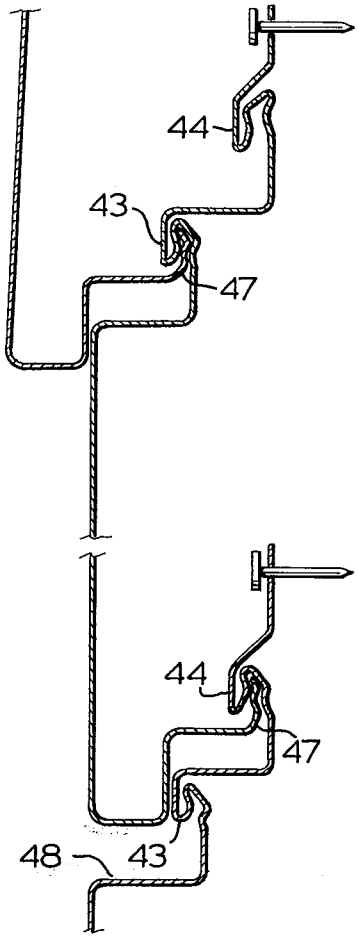

FIG. 4 shows a further modification of FIG. 3 in which modified ribs 43 and 44 are at different levels and are hook-shaped and the recess 37 of FIG. 3 has been replaced by a hook 47 adapted to engage under hook-shaped ribs 43 or 44 in locking engagement in the lap or flush configurations respectively. It will be noted that in the flush configuration, wherein hook 47 engages hook-shaped rib 44, there is provided a surface recess 48 which may be filled with a decorative strip or batten if desired.

Figure 5:
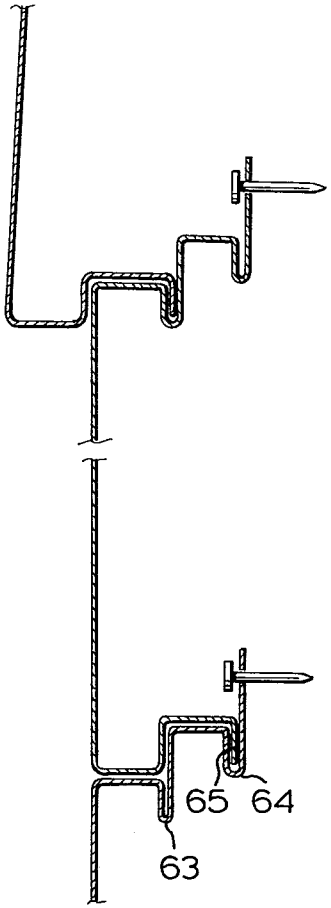

FIG. 5 is somewhat similar to FIGS. 1 and 3 and shows channels or slots 63 or 64, at different levels, adapted to receive the single locking hook 65 of an adjoining panel for assembly in either the flush or lap configuration.

Figure 6:
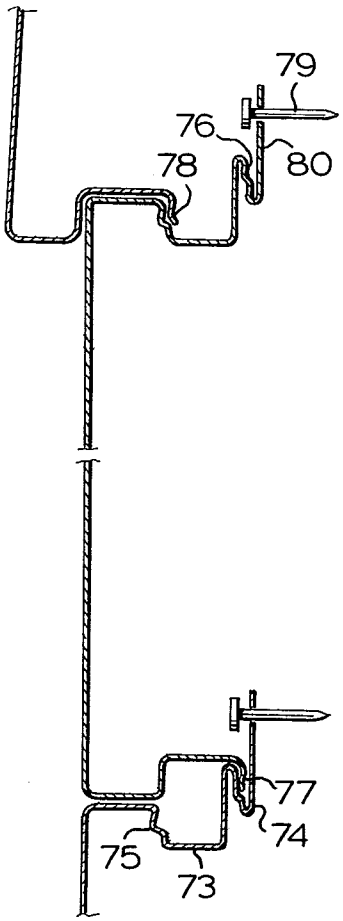

FIG. 6 illustrates a further modification of the embodiment of FIG. 5 for application from the bottom up. Slots 73 and 74 are provided with locking recesses 75 and 76, and a hook 77 has an additional locking device 78 adapted for reception by recesses 75 and 76. Nails 79 are driven through flange 80 to assemble the siding from the bottom up.

It will be appreciated that each of the foregoing embodiments can only be installed from the bottom up when used as horizontal siding, as is usual with conventional lap siding material.

Figure 7:
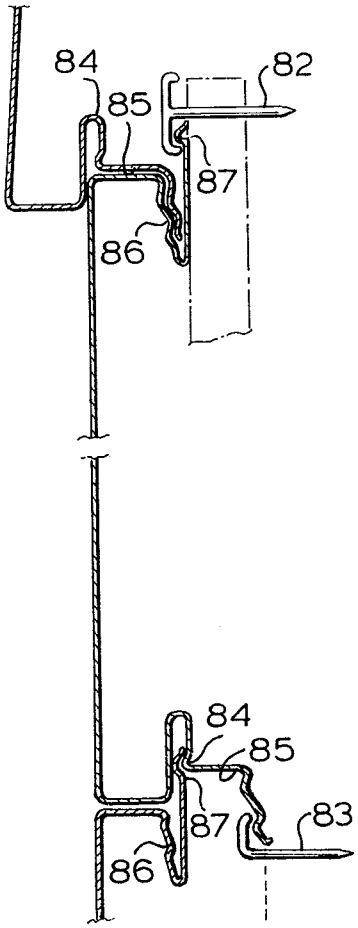

FIG. 7 illustrates an embodiment which differs from previous embodiments in that it is installed from the top for flush application and from the bottom for lap application.

As seen in FIG. 7 a panel is provided which uses either regular nails or specially shaped L, or T nails, 83 and 82 respectively which interlock with nailing flanges on the cladding material. Unlike FIG. 6 however, the FIG. 7 embodiment has first and second engaging means 84 and 85 respectively along one marginal portion of the panel and a third and fourth engaging means 86 and 87 respectively along the other or parallel marginal portion of the panel for selective engagement of engaging means 85 with engaging means 86 and engaging means 84 with engaging means 87 of a corresponding adjacent panel so as to dispose the panel in lap siding of flush relation respectively.

Figure 8:
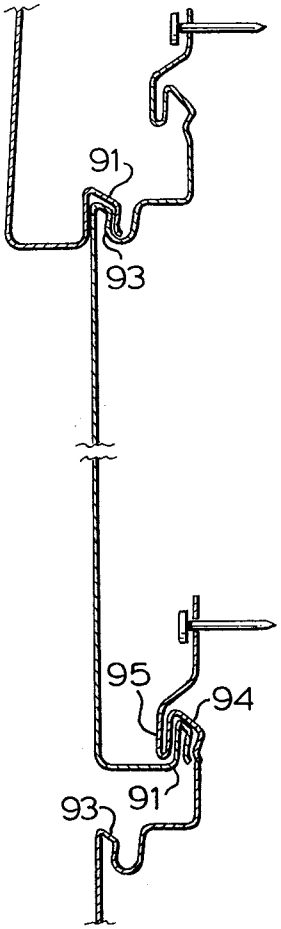

FIG. 8 shows an embodiment which is particularly suited for siding and soffits, and which has along a first marginal edge a lug 93 and a hook-shaped recess means 94 for selective engagement with engaging means 91, of an adjacent panel which is adapted to engage lug 93 in lap relation or be received by recess 94 when disposed in flush relation.

Figure 9:
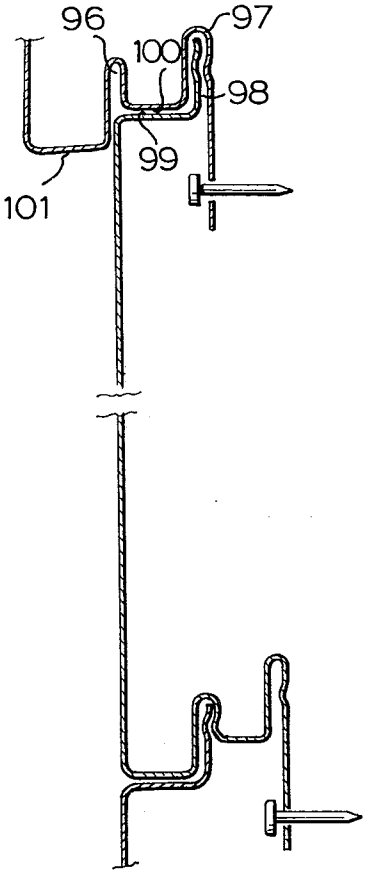

FIG. 9 shows a further embodiment in which the upper portion (as drawn) has a tongue 98, for engagement in one of two channels 96, 97 in the lower portion of an adjacent panel. The tongue is offset rearwardly from a main portion of the panel by a land 99 which is received in a recess 100 from which the channels 96, 97 both extend inwardly. In the lap condition the tongue 98 is in the channel 97 and the land 99 is contained in the recess 100 so that a front portion 101 lies outwardly of the main portion of the panel. A part of the main portion is then contained in the recess 100.

Figure 10:
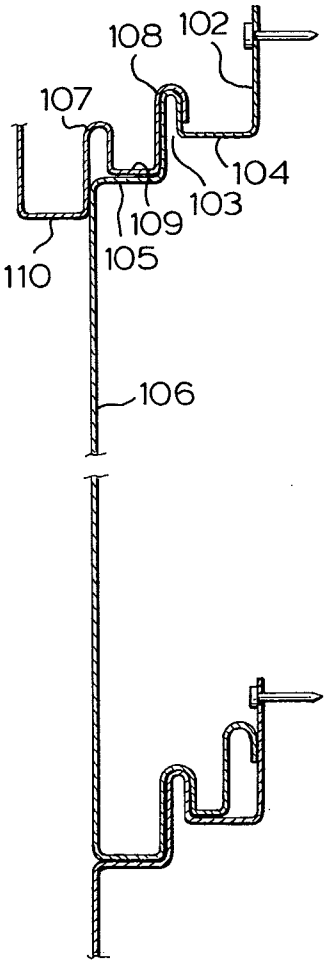

FIG. 10 illustrates yet another embodiment. This embodiment differs from most of the previous embodiments in that the portion of the panel defining a flange 102 is associated with only one engagement means whereas others have been associated with two. In this case a rib 103 is provided forwardly of the flange 102 and separated from the flange by a rearward land 104. A forward land 105 extends between the ribs 103 and a main portion 106 of the panel. This latter land is spaced inwardly from the land 104.

The other marginal portion of the panel defines a pair of channels 107, 108. Channel 108 is spaced inwardly and rearwardly with respect to channel 107 and an intermediate portion 109 extends between the channels and is spaced inwardly with respect to a nose portion 110. Consequently, a part of the front face of main portion 106 is contained behind the nose portion with the panels in the lapped condition.

Although the invention has been illustrated extensively with reference to rolled sections in aluminum sheet, the invention is equally applicable to rolled extruded, moulded and other sections in aluminum, steel, copper or other sheet metal and also to thermosetting and thermoplastic resinous material and to inorganic materials such as asbestos, cement, wood and paper fibres which are conventionally fabricated into sheet form for cladding purposes.

It will also be appreciated that the drawings are illustrative only of the concept of the invention and are not limiting thereon, the scope of the invention being defined only by the appended claims.

Figures 11, 12, 13, 14, 14A, 15, 15A:
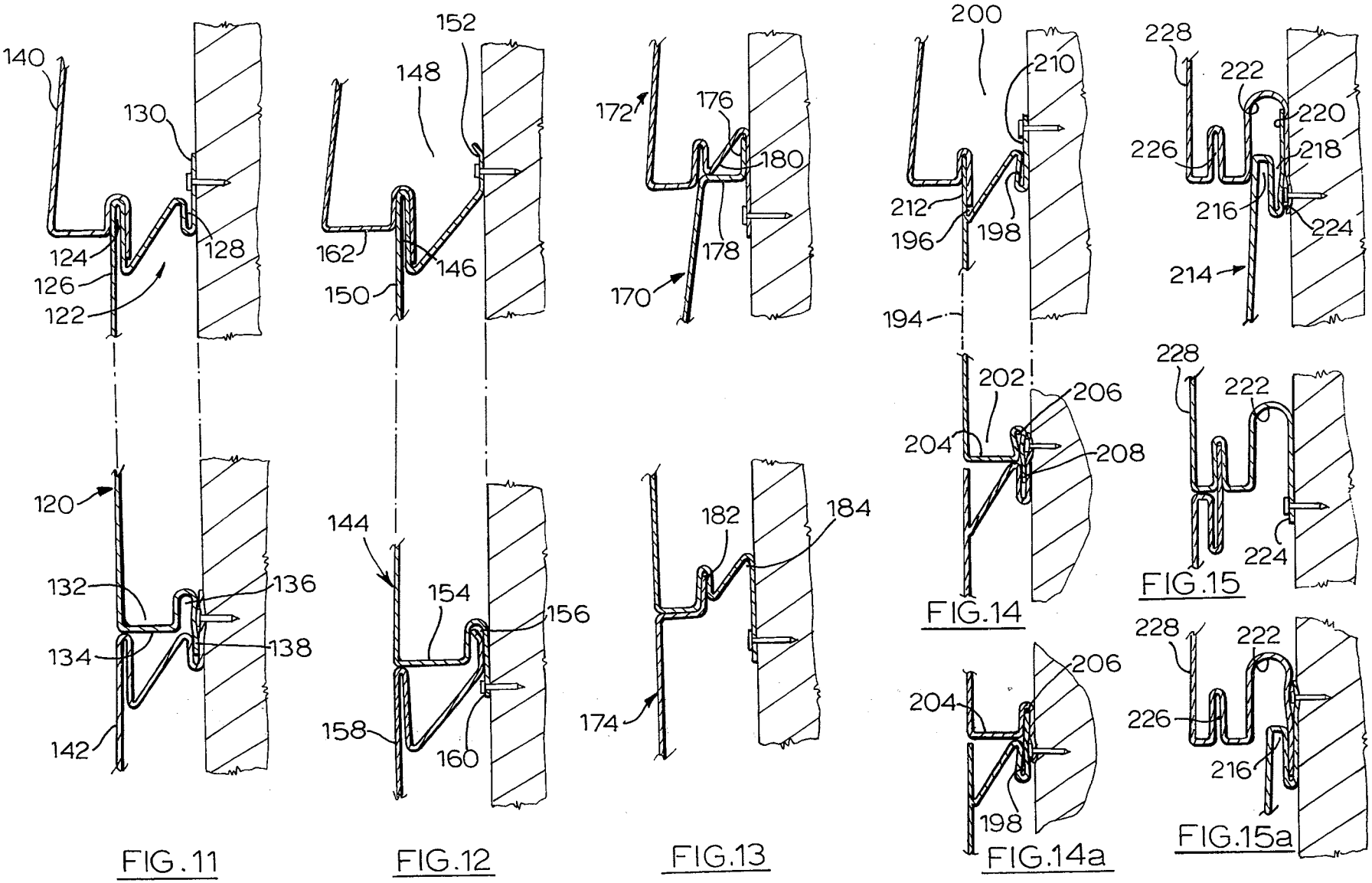

Reference is next made to FIG. 11 which illustrates a further embodiment of the invention. A panel 120 has a first marginal portion 122 defining a rib 124 which is defined in part by a main portion 126 and a recess 128 at a rear most extremity of the portion 122 and terminating in an outwardly projecting flange 130. A second marginal portion 132 at the opposite side of the main portion 126 defines a land 134 which is generally perpendicular to the main portion 120 and which terminates at a rearward recess 136. This channel 136 includes a rearward wall which projects outwardly to define a flange 138.

As seen in the upper portion of FIG. 11, the panel 120 is arranged with an adjacent panel 140 in a lapped condition whereas in a lower portion of this Figure the panel is arranged with a further panel 142 in a flush condition. It will be evident from this Figure that in the lapped condition the rib 124 is used to locate the panel 140 whereas in the flush condition the flange 138 of panel 120 locates in panel 142. In both the flush condition and the lapped condition the flange 130 is used to attach the panel to a building.

An important feature of the structure shown in FIG. 11 is common to many of the previous embodiments. In order that the joint between a panel and an adjacent lapped panel should be hidden, it is important that panel 140 locating on rib 124 should include a portion which overlaps the main portion 126 of the panel 120. To achieve this the engagement means used at the bottom of panel 140 includes a recess corresponding to recess 136 and a forward face of this recess is in face-to-face engagement with the front face of main portion 126. Consequently if there is any slight misalignment although the rib 124 may not be fully engaged in the recess of panel 140 the casual observer will not be aware of the misalignment. This feature is common to all of the succeeding embodiments although their shapes vary significantly.

Reference is next made to FIG. 12 which illustrates a panel 144 which defines a rib 146 in a first marginal portion 148. The recess is adjacent a main portion 150 and the marginal portion terminates in a flange 152 which is used to attach the panel to a building. The other extremity of the main portion 150 is defined by a second marginal portion 154 and this portion defines a rearward recess 156 which as seen in FIG. 12 receives a flange of an adjacent panel 158 in the flush condition. It is to be noticed that in the flush condition a flange 160 extending from the recess 156 is used to attach the panel whereas flange 152 is used in the lapped condition as illustrated by the engagement of another panel 162 with the panel 144.

Reference is next made to FIG. 13 which illustrates a panel 170 interengaged with a panel 174 in the lapped condition and a panel 174 in the flush condition. Panel 170 includes a flange 176 and a land 178 all of which is received in a compound recess 180 of panel 172. This compound recess includes a forward portion 182 and a rearward portion 184 such that in the flush condition the portion 182 receives the flange 176 and locates panel 174 relative to panel 170.

Reference is next made to FIG. 14 which differs from previous embodiments in that the assembly on the wall can be varied. As seen in FIG. 14*a* panel 194 includes a forward recess 196 and a rearward recess 198 in a first marginal portion 200. A second marginal portion 202 includes a land 204 and a rearward recess 206 terminating in a flange 208.

As drawn in FIG. 14, in the lapped condition and in the flush condition a flange 210 on first marginal portion 200 is used to attach the panel to the wall. However, as shown in FIG. 14*a* it is possible with this embodiment to use a flange 208 for attaching the panels in a flush condition.

It is envisaged that the embodiment would be most suitable for extrusion from synthetic plastic material due to the need to provide a rib 212 having a thickness generally equivalent to that of the flange 210. Where the structure is to be made from sheet metal, then the limitations of rolling etc. would probably result in the FIG. 11 structure and the facility illustrated in FIG. 14*a* would be lost.

The last embodiment illustrated is shown in FIG. 15. This Fig. also permits various assemblies. A panel 214 defines a shoulder 216 and a rearward recess 218 terminating in a flange 220. In the lapped condition the shoulder 216 and flange 220 are contained in a rearward recess 222 which in turn terminates in a flange 224 used to attach the panel to a wall. A forward recess 226 is provided between the recess 222 and main portion 228 and as seen in the lower portion of FIG. 16 this recess is used to receive flange 220 of an adjacent panel for attachment in the flush condition.

FIG. 15*a* illustrates an alternative arrangement when assembling the panel in a lapped configuration. In this arrangement flange 220 is used to attach the panel to a wall and then the flange 224 is engaged in the recess 218 with the shoulder 216 projecting into recess 222.

Although the embodiments have been shown in some detail, limitations of drawing have dictated that some variations in structure be omitted. For instance, many of the recesses designed to received flanges can be made such that the mouth of the recess is closed. When the flange is inserted into the recess the flexibility of the material will permit the recess to open and the natural resilience will result in a gripping action on the flange. Also, where there are possible variations in the assembly such as that shown in FIGS. 14*a* and the lower part of FIG. 14, if the recesses to receive the flanges are closed, then when the flanges engage the recess with open. Consequently both of the panels will be separated from the wall by an equal amount giving a satisfying flush appearance without any stagger between the panels.

It will be evident from an inspection of all of the embodiments described that for acceptable use in a lapped condition one of the marginal portions must include a part which is parallel to the main portion and which lies in face-to-face engagement with the main portion of an adjacent panel in this lapped condition. As an example, in FIG. 11 the forward wall of recess 136 lies in face-to-face relationship with the main portion of an adjacent panel in the lapped condition. This is an inherent requirement for acceptable lapped arrangement if misalignment caused by irregular building surfaces is to be hidden in an acceptable fashion. In general therefore an engagement means must be provided on a marginal portion having parts parallel to the main portion for engagement with a main portion of an adjacent panel in the lapped condition. Although such a requirement can be satisfied by numerous embodiments such as those shown in the associated drawings, all such embodiments are within the ambit of the present invention.

What I claim is:

1. An elongated construction panel having a constant cross-section and comprising:

a main portion having a front face which is exposed on assembly of the panel on a building, the main portion having transverse extremities;

marginal first and second portions dependent from said respective transverse extremities of the main portion and extending longitudinally of the panel, these portions extending generally rearwardly with respect to the main portion of the panel;

said first portion defining a first engagement means and a second engagement means spaced rearwardly and outwardly with respect to the first engagement means and terminating in a flange extending outwardly beyond the second engagement means in generally parallel relationship with the main portion for use in attaching the panel to said building;

said second portion defining a third engagement means adapted to selectively co-operate with either another first engagement means of a further panel for producing a lapped siding effect in which an adjacent part of the front face of the further panel is contained in the third engagement means, or another second engagement means of said further panel for producing a flush siding effect.

2. An elongated construction panel as claimed in claim 1 in which the second portion includes a flat portion between the third engagement means and said front of the panel, a substantial part of said flat portion being exposed with the panels in the overlap condition.

3. An elongated construction panel as claimed in claim 1 in which adjacent said panels define longitudinally extending surface recesses between the panels in the flush position for receiving decorative trim.

4. An elongated construction panel having a constant cross-section and defining marginal first and second portions extending longitudinally of the panel and projecting generally rearwardly with respect to a front of the panel which is exposed on assembly of the panel on a building, said first portion defining a first recess and terminating in a flange adjacent the recess, the flange extending outwardly of the panel, said second portion defining a second recess and terminating in a second flange spaced inwardly from the second recess and extending outwardly from the panel so that the second flange can be engaged in a said first recess of another panel to produce a lapped siding effect, the first flange being used to attach the panel to said building, and so that the first flange can be engaged in a said second recess of another panel to produce a flush siding effect, the second flange then being used to attach the panel to said building.

5. A construction panel as claimed in claim 1 in which the first and second engagement means are of similar shape.

6. A construction panel as claimed in claim 1 in which one of said first and second engagement means defines a rib and the other of these means defines a recess, the third engagement means being shaped to receive such a rib on said another panel or to engage in such a recess on said another panel according to said selective co-operation.

7. A construction panel as claimed in claim 1 in which said first and second engagement means are ribs and in which said third engagement means is a channel.

8. A construction panel as claimed in claim 1 in which said first and second engagement means are substantially parallel-sided channels and in which the third engagement means is a flange for engagement in such channels.

9. An elongated construction panel having a constant cross-section and comprising:

a main portion having a front face which is exposed on assembly of the panel on a building, the main portion having transverse extermities;

marginal first and second portions dependent from said respective transverse extremities of the main portion and extending longitudinally of the panel, these portions extending generally rearwardly with respect to the main portion of the panel;

said first portion defining a first channel and a second channel spaced rearwardly and being deeper than the first channel and terminating in a flange extending outwardly beyond the extremity of the main portion and being in generally parallel relationship with the main portion for use in attaching the panel to said building;

said second portion defining a flange spaced rearwardly of the main portion and adapted to selectively co-operate with either another second channel of a further panel for producing a lapped siding effect in which an adjacent part of the front face of the further panel is contained in said first portion, or another first channel of said further panel for producing a flush siding effect.

10. An elongated constructed panel having a constant cross-section and comprising:

a main portion having a front face which is exposed on assembly of the panel on a building, the main portion having transverse extremities;

marginal first and second portions dependent from said respective transverse extremities of the main portion and extending longitudinally of the panel, these portions extending generally rearwardly with respect to the main portion of the panel;

said first portion defining: first and second channels, the second channel being spaced rearwardly and inwardly with respect to the first channel; an intermediate portion extending between the channels; and a nose portion extending from the frist channel to the associated transverse extremity of the main portion, the nose portion being spaced outwardly with respect to the intermediate portion;

said second portion defining a rib, a forward land extending inwardly from the main portion and terminating at the rib, a rearward land lying inwardly with respect to the forward land and extending rearwardly, and a flange extending outwardly from the rearward land in generally parallel relationship with the main portion, the rib being adapted to engage selectively in either another second channel of a further panel for producing a lapped siding effect in which the forward land and the intermediate portion of the further panel are substantially in face-to-face contact, or in another first channel of the further panel for producing a flush siding effect.

11. An elongated construction panel having a substantially constant cross-section and comprising:

a main portion having a front face which is exposed on assembly of the panel on a building, the main portion having transverse extremities;

marginal first and second portions dependent from said respective transverse extremities of the main portion and extending longitudinally of the panel, these portions extending generally rearwardly with respect to the main portion of the panel;

said first and second portions defining respective complementary first and second engagment means such that the first and second engagement means of the panel are engageable respectively with other second and first engagement means of another panel either in a first position such that said main portion lies substantially in the same plane as the main portion of said another panel or in a second position such that said main portion and the main portion of said another panel are spaced generally parallel with one another;

said first portion including a short portion lying generally parallel to said main portion for engagement in overlying relationship with the main portion of the said another panel with the panel and said another panel in said second position; and at least one of the first and second portions defining means adapted to attach the panel to a wall.

12. An elongated construction panel is calimed in claim 1 in which the first engagement means comprises a rib projecting outwardly adjacent the main portion and a first recess rearwardly of the rib and extending inwardly and in which the second engagement means comprises a second recess spaced rearwardly of the main portion and extending inwardly, said short portion defining a forward wall of the second recess, and the second engagement means further comprising a flange extending outwardly at the rearward extremity of the recess whereby in the first position the flange is engaged in the first recess of said another panel and in the second position the rib is engaged in the second recess of said another panel with said short portion in face-to-face engagement with the main portion of the panel and in which said means adapted to attach the panel to a wall comprises a flange defined by the first portion and lying parallel to the main portion and rearwardly of the first engagement means.

13. An elongated construction panel as claimed in claim 11 in which the first portion defines a first land extending rearwardly from the main portion and in which the first engagement means comprises a compound recess rearwardly of the land and extending inwardly, said short portion defining a forward wall of the compound recess and this recess including a forward portion and a rearward portion, and in which the second portion defines a rearwardly extending second land and an outwardly extending flange dependent from this land whereby in the first position the flange is engaged in the forward portion of the compound recess of said another panel and in the second position the second land and flange are contained in the compound recess of said another panel with the flange in the rearward portion of the compound recess and said short portion in face-to-face relationship with the main portion of the panel and in which said means adapted to attach the panel to a wall comprises a flange defined by the first portion and lying parallel to the main portion and rearwardly of the first engagement means.

14. An elongated construction panel as claimed in claim 11 in which the first portion defines a first land extending rearwardly from the main portion and in which the first engagement means comprises a recess rearwardly of the land and extending inwardly, said short portion defining a forward wall of the recess, and in which the second engagement means defines a rib adjacent the main portion and a flange spaced rearwardly of the rib and extending outwardly beyond the rib parallel relation with the main portion whereby in the first position the flange is engaged in the recess of said a another panel and in the second position the rib is engaged in the recess of said another panel with said short portion in face-to-face relationship with the main portion of the panel and in which said means adapted to attach the panel to a wall comprises of further flange extending outwardly from a rearward extremity of said recess for attaching the panel to a wall in said first position and in which said panel is attached to the wall in said second position using the first-mentioned flange.

15. An elongated construction panel as claimed in claim 14 in which the second engagement means further includes a further recess spaced rearwardly of the rib to provide an alternative assembly in the first position whereby said further recess receives said first-mentioned flange.

16. An elongated construction panel as claimed in claim 11 in which the first engagement means comprises first and second recesses extending inwardly, said short portion forming a forward wall of said second recess and said second recess being rearwardly of said first recess, and in which said second portion defines a shoulder adjacent the main portion and in which said second engagement means includes a flange rearwardly of the shoulder and extending outwardly whereby in said first position said flange is engaged in the first recess of said another panel, and in the second position the shoulder and flange are contained in the second recess of said another panel with said short portion in face-to-face engagement with the main portion, and in which said means adapted to attach the panel to a wall comprises a further flange defined by the first portion and lying parallel to the main portion and rearwardly of the first engagement means.

17. An elongated construction panel as claimed in claim 16 in which the second engagement meas further defines a third recess adjacent the first-mentioned flange whereby this first-mentioned flange can be used to attach the panel to a wall in a further first position such that the further flange of said another panel is engaged in the third recess with said short portion in face-to-face relationship with the main portion.

* * * * *

UNITED STATES PATENT OFFICE
CERTIFICATE OF CORRECTION

Patent No. 4,122,643 Dated October 31, 1978

Inventor(s) Hafner

It is certified that error appears in the above-identified patent and that said Letters Patent are hereby corrected as shown below:

Column 2, line 31, change "1a" to read --14a--.

Column 2, line 32, change "15" to read --14--.

Column 2, line 33, change "16" to read --15--.

Column 2, line 54, change "extermities" to read --extremities--.

Column 5, line 46, change "174" to read --172--.

Column 5, line 52, should be changed to read --the portions 182, 184 receive the flange 176 and locate panel--.

Column 6, line 34, change "with" to read -- will--.

Column 7, line 66, change "extermities" to read --extremities--.

Column 10, line 45, change "meas" to read --means--.

Signed and Sealed this

*Eleventh* Day of *December 1979*

[SEAL]

*Attest:*

SIDNEY A. DIAMOND

*Attesting Officer* *Commissioner of Patents and Trademarks*